US005746120A

United States Patent [19]

Jonsson

[11] Patent Number: 5,746,120

[45] Date of Patent: May 5, 1998

[54] TYING DEVICE IN WHICH THE DRIVE MEANS ARE ELECTRIC SERVOMOTORS

[75] Inventor: Age Jonsson, Sundsvall, Sweden

[73] Assignee: Sunds Defibrator Industries AB, Sweden

[21] Appl. No.: 615,262

[22] PCT Filed: Oct. 6, 1994

[86] PCT No.: PCT/SE94/00929

§ 371 Date: Mar. 11, 1996

§ 102(e) Date: Mar. 11, 1996

[87] PCT Pub. No.: WO95/10452

PCT Pub. Date: Apr. 20, 1995

[30] Foreign Application Priority Data

Oct. 14, 1993 [SE] Sweden ..... 9303380

[51] Int. Cl.[6] ..... B65B 13/28; B65B 13/06

[52] U.S. Cl. ..... 100/4; 100/26; 100/31; 53/589

[58] Field of Search ..... 100/4, 26, 31, 100/33 R; 53/589

[56] References Cited

U.S. PATENT DOCUMENTS

| | | | |
|---|---|---|---|
| 2,416,859 | 3/1947 | Vining et al. | 100/31 |
| 2,957,406 | 10/1960 | Copland et al. | 100/31 |
| 3,039,380 | 6/1962 | Sansum | 100/31 |
| 3,052,178 | 9/1962 | Hall . | |
| 3,088,397 | 5/1963 | Martin et al. . | |
| 3,889,584 | 6/1975 | Wiklund | 100/31 |
| 3,929,063 | 12/1975 | Stromberg et al. . | |
| 4,252,157 | 2/1981 | Ohnishi | 100/31 |
| 4,561,234 | 12/1985 | Tonus | 100/26 |
| 4,912,912 | 4/1990 | Tagomori . | |
| 5,027,701 | 7/1991 | Izui et al. | 100/31 |
| 5,146,847 | 9/1992 | Lyon et al. | 100/26 |

FOREIGN PATENT DOCUMENTS

| | | |
|---|---|---|
| 103479 | 1/1964 | Norway . |
| 542750 | 11/1973 | Switzerland . |
| 1451136 | 9/1876 | United Kingdom . |

*Primary Examiner*—Stephen F. Gerrity
*Attorney, Agent, or Firm*—Lerner, David, Littenberg, Krumholz & Mentlik

[57] ABSTRACT

Apparatus for tying objects with wire is disclosed including a feeder for feeding and tightening the wire around the object, the feeder being driven by an electric servomotor which can be rotated through a predetermined number of revolutions for feeding and tightening the wire, an adjustable guide rail for guiding the wire around the object and for tightening the wire when the guide rail is opened, a locking unit for locking the wire around the object, a wire twister for twisting the wire into a knot, the wire twister being driven by an electric servomotor so that it can be rotated through a predetermined number of revolutions for twisting the wire into a knot, and a wire cutter for cutting the wire after the knot has been formed.

17 Claims, 3 Drawing Sheets

TYING DEVICE IN WHICH THE DRIVE MEANS ARE ELECTRIC SERVOMOTORS

FIELD OF THE INVENTION

The present invention relates to a device for tying objects with wire, for example bales of fiber material.

BACKGROUND OF THE INVENTION

Pulp bales can either be individually tied into bales, or this can be done in the form of stacked units comprising a certain number of bales, normally six or eight. Such a unit load will generally have a weight of between one and two tons. The strength of the wire connection which is used to bind together the unit load, therefore, is very important from the point of view of safety, particularly since several persons can stand close to the load when it is being lifted by means of such wires. The equipment used for twisting the knot in a tied loop, as well as the knot itself, therefore, is subject to very comprehensive safety regulations and accurate safety control.

The tying device generally comprises a unit for feeding the wire through an openable wire guide rail around the object. The feed unit is also used for tightening the wire. A twisting member is also generally utilized, which comprises a unit for locking the end of the wire, a unit for twisting a wire knot, a cutting unit, and a unit for pushing out the knot.

The wire guide rail extends about the object to be tied and guides the wire while it is being fed. The wire is then fed through the twisting member about the object to be tied. When the free end of the wire thus arrives at the twisting member for the second time, the wire is stopped and retained in the locking unit, whereafter it is tightened by reversing the feed unit. The wire guide rail is thus opened after the wire has been fed around the object, and the wire is then drawn around the object to be tied, the knot is twisted, the wire is cut and pushed out of the twisting member.

These various units are normally driven and controlled hydraulically by motors and cylinders. It has been found, however, that this drive system fails to work with the desired degree of precision during the tying process. Ample margins are, therefore, required to ensure its proper functioning, especially during the wire feeding, wire tightening and twisting steps. This also implies that the wire can be subjected to such stresses during tying, that the wire must be designed thicker than would be required for merely holding the tied objects together. The hydraulic motors, furthermore, require relatively complicated and bulky hydraulic assemblies, which creates the risk of functional disorder and high service costs.

SUMMARY OF THE INVENTION

According to the present invention, these and other objects have now been achieved by the invention of apparatus for tying objects with wire having an end which comprises feed means for feeding and tightening the wire around the object, feed drive means for driving the feed means, the feed drive means comprising a first electric servomotor, whereby the first electric servomotor can be rotated through a first predetermined number of revolutions for feeding and tightening the wire around the object, a guide rail adjustable between opened and closed conditions for guiding the wire around the object, whereby the guide rail can guide the wire around the object when in its closed condition and the wire can be tightened around the object when the guide rail is in its opened condition, locking means for locking the wire around the object after the end of the wire has been fed entirely around the object, wire twisting means for twisting the end of the wire into a knot, wire twisting drive means for driving the wire twisting means, the wire twisting drive means comprising a second electric servomotor whereby the second electric servomotor can be rotated through a second predetermined number of revolutions for twisting the end of the wire into a knot, and wire cutting means for cutting the wire after the knot has been formed.

In accordance with one embodiment of the apparatus of the present invention, the apparatus includes wire indicator means for indicating the position of the end of the wire proximate to the locking means.

In accordance with another embodiment of the apparatus of the present invention, the apparatus includes ejecting means for ejecting the knot from the apparatus. Preferably, the apparatus also includes pneumatic actuator means for actuating the guide rail and the ejecting means.

In accordance with another embodiment of the apparatus of the present invention, the apparatus includes pneumatic actuator means for actuating the guide rail.

In accordance with another embodiment of the apparatus of the present invention, the apparatus includes combined pneumatic and hydraulic actuating means for actuating the locking means and the wire cutting means.

In accordance with another embodiment of the apparatus of the present invention, the apparatus includes a plurality of transmitters positioned around the object for indicating the position of the wire whereby the apparatus can be operated based thereon.

BRIEF DESCRIPTION OF THE DRAWINGS

The present invention can be more fully appreciated with reference to the following detailed description, which, in turn, refers to the drawings in which.

DETAILED DESCRIPTION

Figure 1:
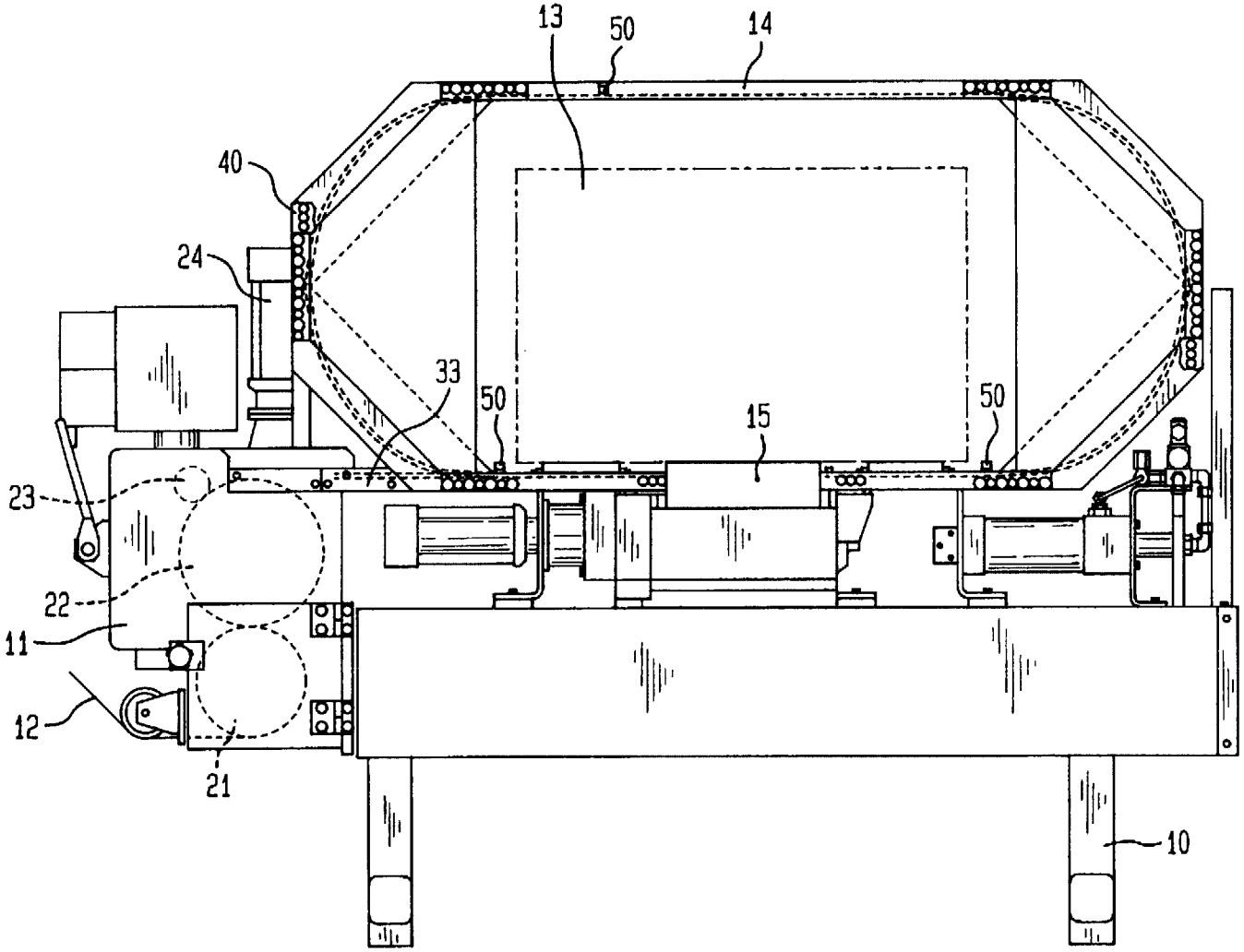
FIG. 1 is a side elevational, partially schematic view of a tying apparatus in accordance with the present invention.
Figure 2:
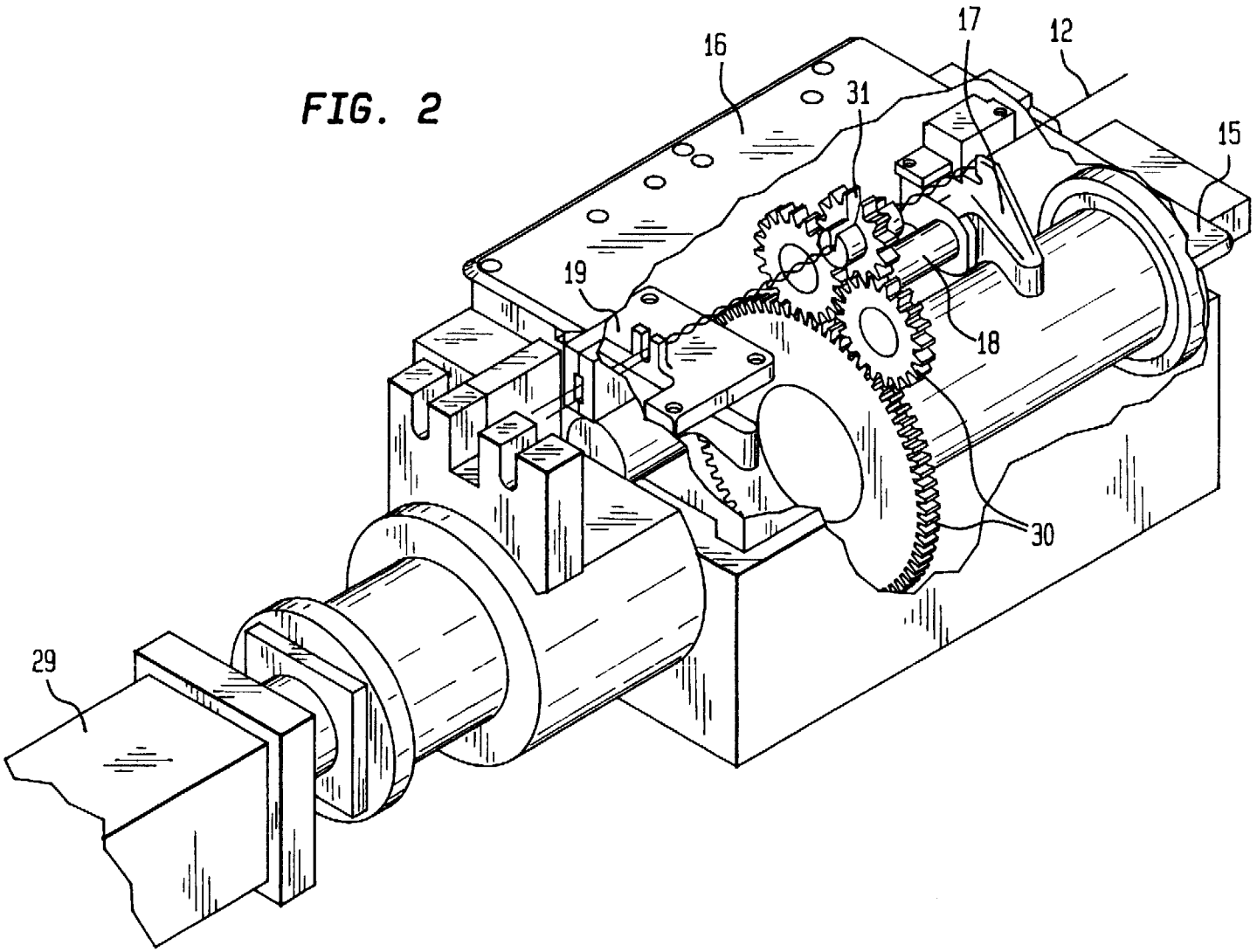
FIG. 2 is a top perspective, partially cutaway view of a wire twisting means for use in connection with the apparatus of the present invention.
Figure 3:
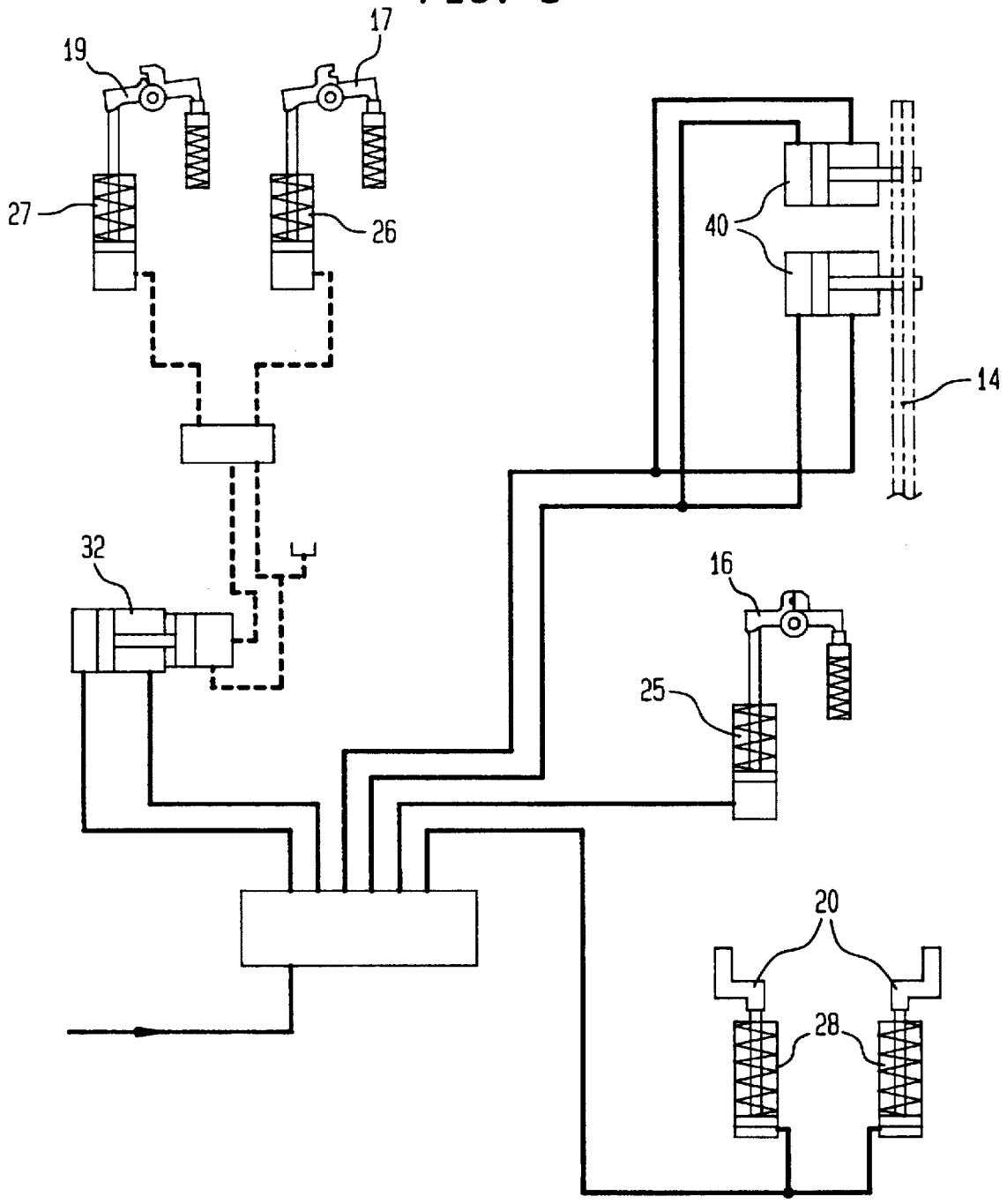
FIG. 3 is a schematic representation of a pneumatic and/or hydraulic system for use in controlling the various elements of the apparatus of the present invention.

The tying device of the present invention is of the general type shown and described in Swedish Patent No. SE 380,496 (see U.S. Pat. No. 3,929,063. Referring to the drawings, in which like reference numerals refer to like elements thereof, the tying device hereof comprises a stand 10, on which the different units are arranged. A feed unit 11 feeds tying wire 12 from a wire magazine around the object to be tied 13 and thereafter tightens the wire. A wire guide rail 14 extends about the object 13. A twisting member 15 comprises a guide rail 16 for guiding the wire through the twisting member 15, a unit 17 for locking the end of the wire, a unit 18 for twisting a wire knot, a unit 19 for cutting the wire, and a unit 20 for pushing out the finished twisted knot.

The entire tying device is preferably movable so that it can be placed in a conveying track for the objects to be tied, and can be easily replaced when required.

The feed unit 11 comprises a guide wheel 21, about which the wire 12 runs, and a driven feed wheel 22, to which at least one counter-pressure roll 23 abuts. The feed wheel 22 is driven by first electric servomotor 24.

The wire guide rail 14 is openable and provided with grooves for the wire 12. During feeding of the wire, the rail 14 is held in closed position, preferably by means of pneumatic piston/cylinder units 40. During tightening of the wire, the wire guide rail 14 is opened by the piston/cylinder units 40.

The tying member 15 is exchangeable, and is detachably attached to the drive means for the units 16–20 of the tying member. The drive means are springloaded single-acting piston/cylinder units 25–28, which actuate the guide rail 16, locking unit 17, cutting unit 19 and push-out unit 20, as well as a second electric servomotor 29, which actuates the twisting roll 31 of the twisting unit 18 by means of pinions 30.

The piston/cylinder units 25 and 28, which actuate the guide rail 16 and push-out unit 20 are preferably included in a pneumatic system, while the piston/cylinder units 26 and 27, which actuate the units 17 and 19 for locking and cutting, are preferably included in a combined pneumatic/hydraulic system. In this combined system the piston/cylinder units 26 and 27 are directly actuated hydraulically from a pneumatically actuated power amplifying hydraulic cylinder 32. In this manner, the hydraulic system is minimized while at the same time power and safety are maintained.

During the feeding of the wire, the feed unit 11 is driven by the first electric servomotor 24 through a predetermined number of revolutions, so that a definite wire length is fed around the object 13 and the wire end arrives at the locking unit 17. The length of the wire feed 12 is counted from the wire end passing an indicator 33 located at the in-feed. The wire end is retained in the locking unit 17.

The wire is thereafter tightened by reversing the servomotor 24 of the feed unit 11 until the wire has been tightened down onto the object 13, and the necessary torque in the servomotor 24 has been obtained.

After the predetermined torque for wire tightening has been achieved and been maintained for a short time, the second electric servomotor 29 is activated for driving the twisting roll 31 of the twisting unit 18. Rotation of the servomotor 29 is controlled so that the twisting roll 31 is first rotated through a predetermined number of revolutions and an additional angle and thereafter is reversed through the same angle. In this manner, a certain over-twisting is obtained, which compensates for the spring back of the wire knot.

When the twisting step is completed, the wire is cut in the cutting unit 19, and the push-out unit 20 ensures that the knot leaves the tying member 15.

After it has been cut, the wire is pulled back by the feed unit 11 past the indicator 13, and the device is ready for a new tying operating.

By using electric servomotors for driving the feed unit and the twisting unit, it is possible to accurately control the wire feed, wire tightening and twisting steps. The number of revolutions and the angular position of the servomotors can be indicated, for example, by pulse metering or in some other way. Speed, acceleration and retardation of the servomotors can be controlled so that jerks and jolts in the wire are avoided. It has thus been found possible according to the present invention to reduce the wire diameter while maintaining functional safety, compared with conventional equipment, for example from 2.3 mm to 2 mm.

In addition to the indication equipment mentioned above, transmitters 50 can be positioned at different locations for indicating the position of the wire and movable parts of the different units. Such an arrangement can be utilized advantageously, for example, for functional information and trouble shooting.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for tying objects with wire having an end comprising feed means for feeding and tightening said wire around said object, feed drive means for driving said feed means, said feed drive means comprising a first electric servomotor whereby said first electric servomotor can be rotated through a predetermined number of revolutions for feeding said wire around said object and can be counter-rotated through a predetermined number of revolutions for tightening said wire around said object, a guide rail adjustable between opened and closed conditions for guiding said wire around said object whereby said guide rail can guide said wire around said object when in said closed condition and said wire can be tightened around said object when said guide rail is in said opened condition, locking means for locking said wire around said object after said end of said wire has been fed entirely around said object, wire twisting means for twisting said end of said wire into a knot, wire twisting drive means for driving said wire twisting means, said wire twisting drive means comprising a second electric servomotor whereby said second electric servomotor can be rotated through a predetermined number of revolutions for twisting said end of said wire into said knot, and wire cutting means for cutting said wire after said knot has been formed.

2. The apparatus of claim 1 including wire indicator means for indicating the position of said end of said wire proximate to said locking means.

3. The apparatus of claim 1 including ejecting means for ejecting said knot from said apparatus.

4. The apparatus of claim 3 including pneumatic actuator means for actuating said guide rail and said ejecting means.

5. The apparatus of claim 1 including pneumatic actuator means for actuating said guide rail.

6. The apparatus of claim 1 including combined pneumatic and hydraulic actuator means for actuating said locking means and said wire cutting means.

7. Apparatus for tying objects with wire having an end comprising feed means for feeding and tightening said wire around said object, feed drive means for driving said feed means, said feed drive means comprising a first electric servomotor whereby said first electric servomotor can be rotated through a predetermined number of revolutions for feeding said wire around said object and can be counter-rotated through a predetermined number of revolutions for tightening said wire around said object, a guide rail adjustable between opened and closed conditions for guiding said wire around said object whereby said guide rail can guide said wire around said object when in said closed condition and said wire can be tightened around said object when said guide rail is in said opened condition, locking means for locking said wire around said object after said end of said wire has been fed entirely around said object, wire twisting means for twisting said end of said wire into a knot, wire twisting drive means for driving said wire twisting means, said wire twisting drive means comprising a second electric servomotor whereby said second electric servomotor can be rotated through a predetermined number of revolutions for twisting said end of said wire into said knot, wire cutting means for cutting said wire after said knot has been formed, and wire indicator means for sensing said end of said wire proximate said feed drive means to determine a position of said end of said wire proximate to said locking means.

8. The apparatus of claim 7 including ejecting means for ejecting said knot from said apparatus.

9. The apparatus of claim 8 including pneumatic actuator means for actuating said guide rail and said ejecting means.

10. The apparatus of clam 7 including pneumatic acutuator means for actuating said guide rail.

11. The apparatus of claim 7 including combined pneumatic and hydraulic means for actuating said locking means and said wire cutting means.

12. Apparatus for tying objects with wire having an end comprising feed means for feeding and tightening said wire around said object, feed drive means for driving said feed means, said feed drive means comprising a first electric servomotor whereby said first electric servomotor can be rotated through a predetermined number of revolutions for feeding said wire around said object and can be counter-rotated through a predetermined number of revolutions for tightening said wire around said object, a guide rail adjustable between opened and closed conditions for guiding said wire around said object whereby said guide rail can guide said wire around said object when in said closed condition and said wire can be tightening around said object when said rail is in said opened condition, locking means for locking said wire around said object after said end of said wire has been fed entirely around said object, wire twisting means for twisting said end of said wire into a knot, wire twisting drive means for driving said wire twisting means, said wire twisting drive means comprising a second electric servomotor whereby said second electric servomotor can be rotated through a predetermined number of revolutions for twisting said of said wire into said knot, wire cutting means for cutting said wire after said knot has been formed, and a plurality of transmitters positioned around said object for identifying the position of said wire whereby said apparatus can be operated based thereon.

13. The apparatus of claim 12 including wire indicator means for indicating the position of said end of said wire proximate to said locking means.

14. The apparatus of claim 12 including ejecting means for ejecting said knot from said apparatus.

15. The apparatus of claim 14 including pneumatic actuator means for actuating said guide rail and said ejecting means.

16. The apparatus of claim 12 including pneumatic actuator means for actuating said guide rail.

17. The apparatus of claim 12 including combined pneumatic and hydraulic actuator means for actuating said locking means and said wire cutting means.

* * * * *

UNITED STATES PATENT AND TRADEMARK OFFICE

CERTIFICATE OF CORRECTION

PATENT NO. : 5,746,120

DATED : May 5, 1998

INVENTOR(S) : Jonsson

It is certified that error appears in the above-identified patent and that said Letters Patent is hereby corrected as shown below:

Column 2, line 52, "3,929,063." should read-- 3,929,063).--

Column 3, line 53, "13" should read --33--.

Column 3, line 54, "operating" should read --operation--.

Column 6, line 1, "tightening" should read --tightened--.

Signed and Sealed this

First Day of September, 1998

Bruce Lehman

*Attest:*

BRUCE LEHMAN

*Attesting Officer*

*Commissioner of Patents and Trademarks*